United States Patent [19]

Sundstrom

[11] 4,223,658

[45] Sep. 23, 1980

[54] ELASTIC BAND PROJECTING TOY GUN

[76] Inventor: Paul Sundstrom, 53 Barney St., Gladstone, Queensland, 4680, Australia

[21] Appl. No.: 924,190

[22] Filed: Jul. 13, 1978

[30] Foreign Application Priority Data

Jul. 18, 1977 [AU] Australia ..... PD0883

[51] Int. Cl.[3] ..... F41B 7/02

[52] U.S. Cl. ..... 124/19; 124/80

[58] Field of Search ..... 124/19, 18, 17, 35 R, 124/41 R, 48

[56] References Cited

U.S. PATENT DOCUMENTS

| | | | |
|---|---|---|---|
| 1,724,271 | 8/1929 | Fisher | 124/19 |
| 1,826,053 | 10/1931 | Carpenter | 124/19 |
| 1,935,287 | 11/1933 | Damico | 124/19 |
| 1,944,377 | 1/1934 | Taylor | 124/18 |
| 2,741,238 | 4/1956 | Arnold | 124/19 |

*Primary Examiner*—Richard C. Pinkham

*Assistant Examiner*—William R. Browne

*Attorney, Agent, or Firm*—Henry M. Bissell

[57] ABSTRACT

A toy gun which is capable of firing a plurality of elasticized bands, either singularly or in rapid succession, and which is operative so that each one of a plurality of elasticized bands is stretched under the tension of its own elasticity along a projectile path longitudinal with the gun between a point of anchorage at the forward end of the gun and a rotatable escapement wheel at the rearward end of the gun so that, when the escapement wheel is permitted to rotate under the influence of a rotational bias provided by the force of the previously loaded elasticized bands upon the release of a trigger mechanism, the elasticized bands are consecutively released from engagement with the escapement wheel to be propelled along the projectile path and forwardly of the gun. The wheel includes a plurality of spaced apart radially extending sections that have successively increasing radii over substantially the entire outer-most periphery of all of the sections.

8 Claims, 5 Drawing Figures

ELASTIC BAND PROJECTING TOY GUN

This invention relates to a toy gun which is capable of firing a plurality of elasticized bands, either singularly or in rapid succession, as determined by the operator.

Hitherto, many forms of toy guns have been developed for the purpose of firing elasticized bands or other forms of projectile. However, previously known toy guns of this type have only been capable of a single firing for each loading operation. Since toy guns of this type are normally of interest only to children, the necessity to pause between each firing in order to reload the gun can be inconvenient and frustrating to the extent that a child might eventually be motivated to put the gun aside because it is not providing sufficient satisfaction for the amount of patience required.

A further disadvantage of the aforementioned prior art is that existing toy guns which are capable of firing elasticized bands are also capable of firing other, more dangerous forms of projectiles. A child using such a gun might easily be tempted to load the gun with a stone, lead pellet or similar projectile to be propelled by the elasticized band being fired. The accident potential of such a situation is quite obvious.

Primarily, the present invention provides a toy gun which has the capability of firing a pluraity of elasticized bands, either singularly or in rapid succession, for only one loading operation. In a further embodiment, the present invention also provides a toy gun which is impervious to the introduction of any projectile other than the elasticized bands with which the gun is intended to be used.

Accordingly with the essential aspects of the present invention, there is provided a toy gun capable of propelling a plurality of elasticized bands, either singularly or in rapid succession, said gun comprising an elongate body member having a forward and a rearward end and defining a projectile path longitudinal therewith, a spring loaded trigger mechanism mounted on said body member and having a portion thereof engaging with any one of a plurality of corresponding portions on the periphery of a rotatably mounted escapement wheel located rearwardly of said projectile path and substantially the line therewith so that said escapement wheel is locked against free rotation by said interengaging portions when said trigger mechanism is positionally biased by the influence of its spring loading, said trigger mechanism being actuable against the influence of its spring loading to cause disengagement of said interengaging portions so that said escapement wheel is freed for rotation in both directions, said escapement wheel including a plurality of radially extending engagement means located at space apart intervals therearound and adapted for releasable engagement with a corresponding plurality of elasticized bands, said body member further including a projection located forwardly of said projectile path for releasable engagement with one or more of said plurality of elasticized bands, the arrangement being such that, in operation, each of said plurality of elasticized bands is stretching along said projectile path between said projection and said corresponding engagement means so that, as each elasticized band is loaded into the gun, said escapement wheel is moved in one direction through corresponding steps of rotation defined by each adjacent pair of said corresponding portions so that escapement wheel is biased for rotation in the other direction under the tension of each of said plurality of elasticized bands, said gun being operative so that, when said trigger mechanism is actuated as aforesaid, said escapement wheel is thereby freed for said biased rotation in said other direction to enable the consecutive release of said plurality of elasticized bands from said corresponding engagement means for propulsion along said projectile path and forwardly of said gun.

A preferred embodiment of the present invention will now be described with reference to the accompanying drawings, in which.

Figure 1:
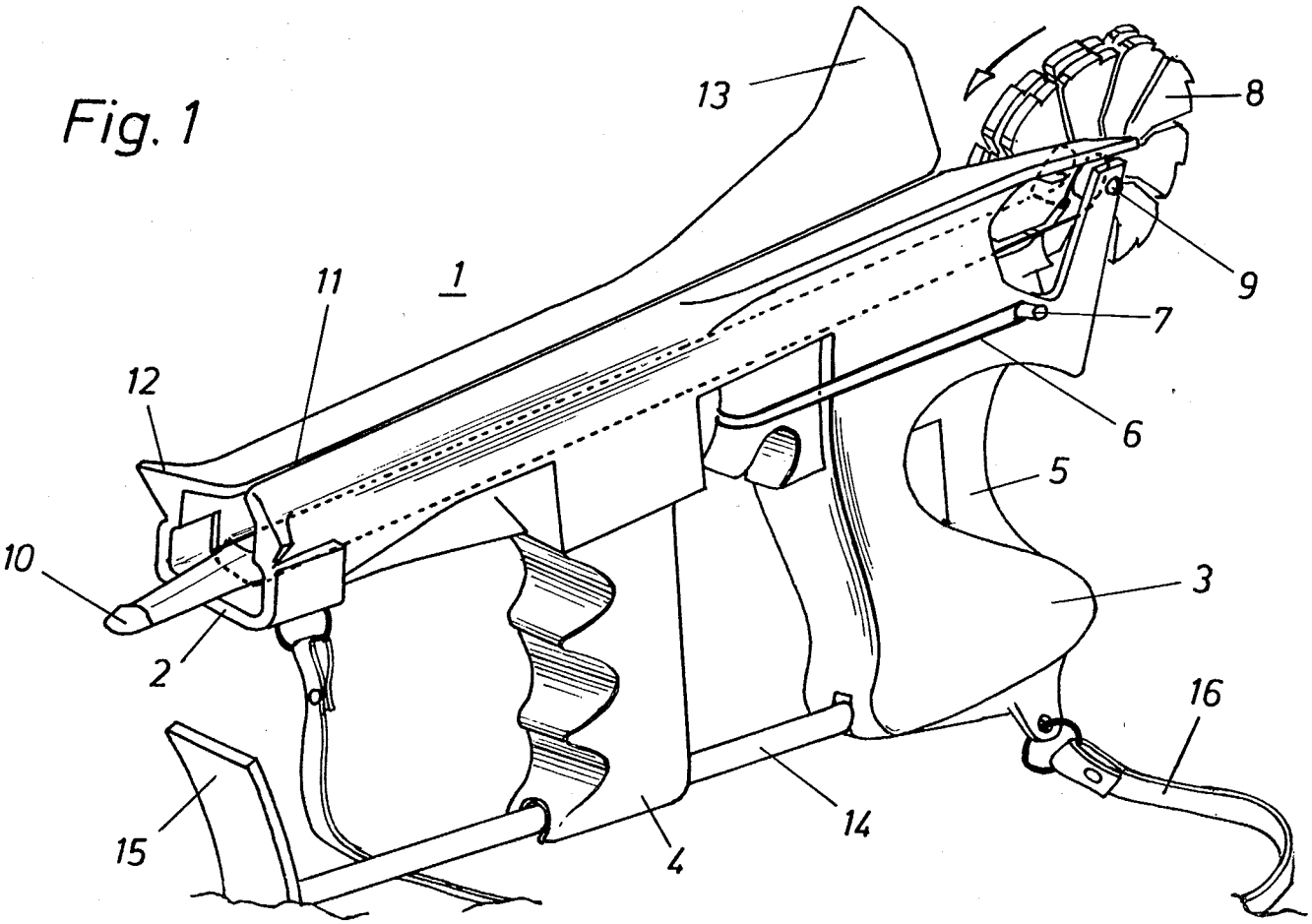
FIG. 1 is a perspective view of a toy gun made in accordance with the present invention.
Figure 2:
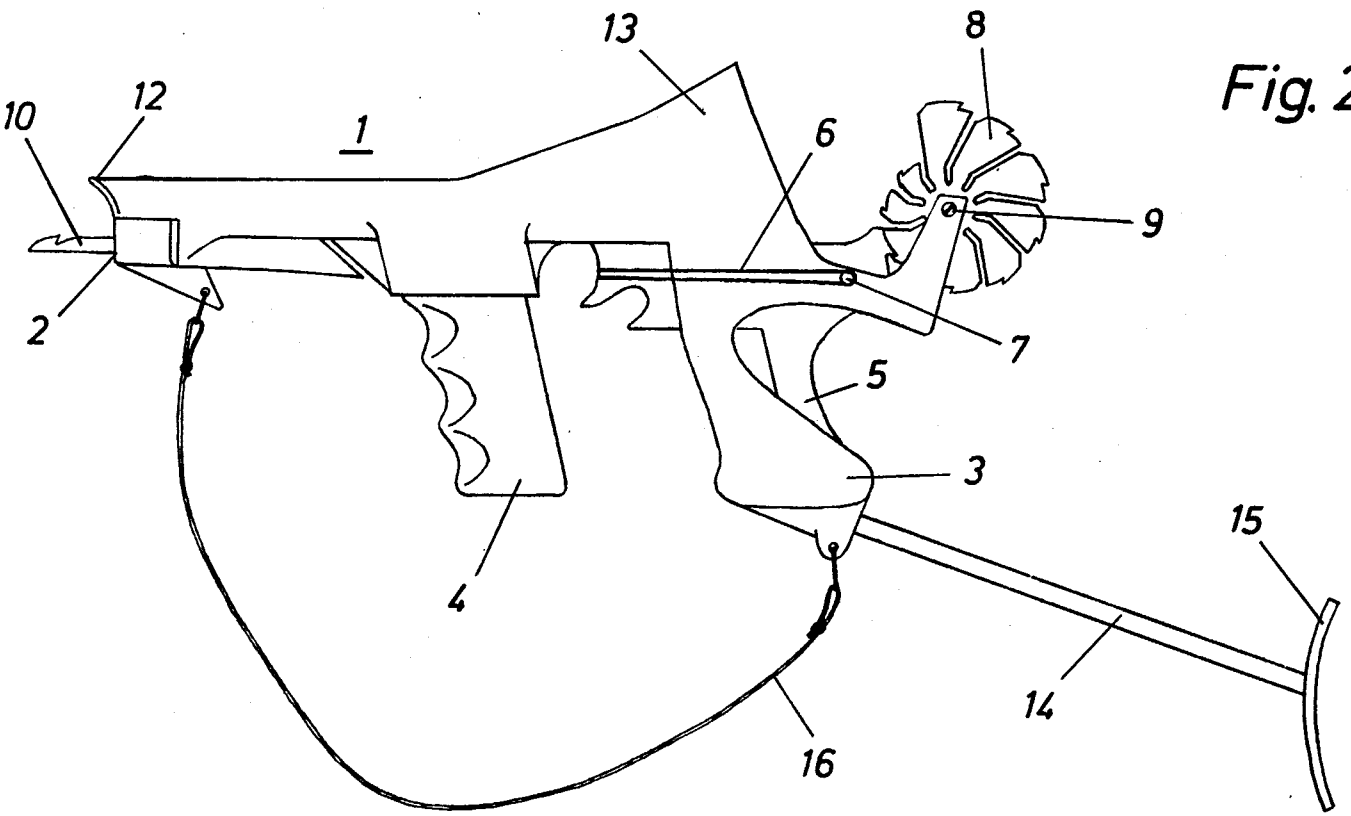
FIG. 2 is a side elevational view of the toy gun shown in FIG. 1.

Referring now to FIGS. 1 and 2 of the accompanying drawings, a toy gun 1 comprises a body member 2 having a forward and a rearward end. Incorporated into the body member 2 is a rearward hand grip 3 and a forward hand grip 4.

A hand actuable trigger 5 is slidably located within the rearward hand grip 3 and is positionally biased in a rearward direction by an elasticized band 6 coupled between a pair of posts 7 mounted, one on each side of the body member 2. Because of the positional bias on the trigger 5 established by the force of the elasticized band 6, a rearward portion of the trigger engages with one of a plurality of corresponding portions situated around the periphery of an escapement wheel 8 which is rotatably mounted on the body member, rearwardly of the trigger mechanism, by a suitable axle arrangement 9.

A projection or spike 10 extends from the body member 2 at the forward end thereof. An elongate channel 11 passes longitudinally through the body member 2 to provide an uninterrupted projectile path between the escapement wheel 8 and the projection 10, and is preferably represented by a hollowed out, longitudinal passage passing through the body member and communicating along its length with the outside thereof by means of a relatively narrow, longitudinal opening.

Figure 3:
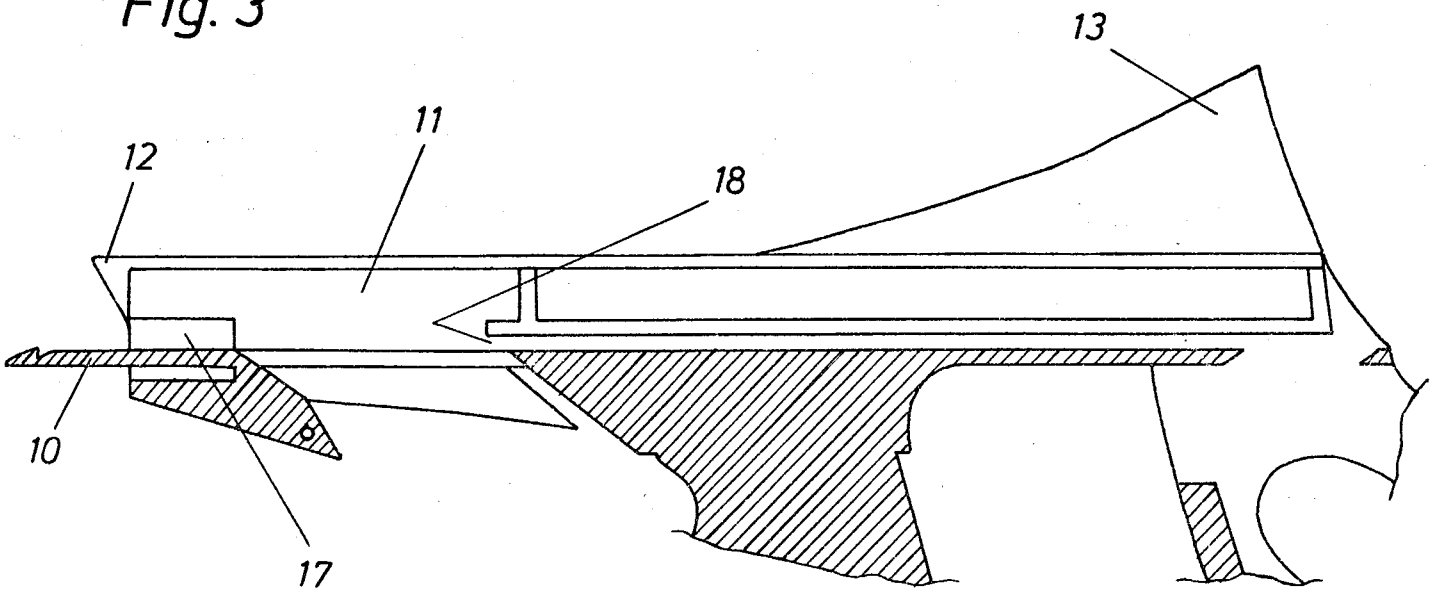
FIG. 3 is a side elevational cut-away view of the barrel section of the toy gun shown in FIG. 1.
Figure 5:
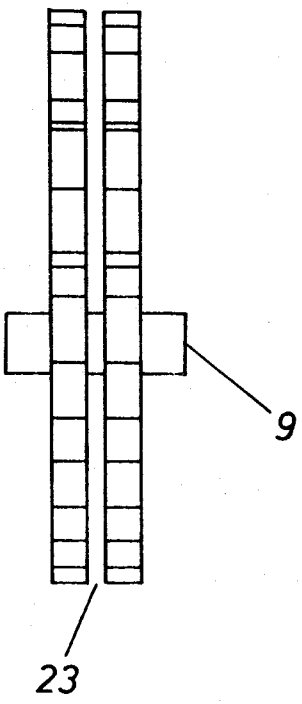
FIG. 5 is an end elevational view of the escapement wheel shown in FIG. 4.
Figure 4:
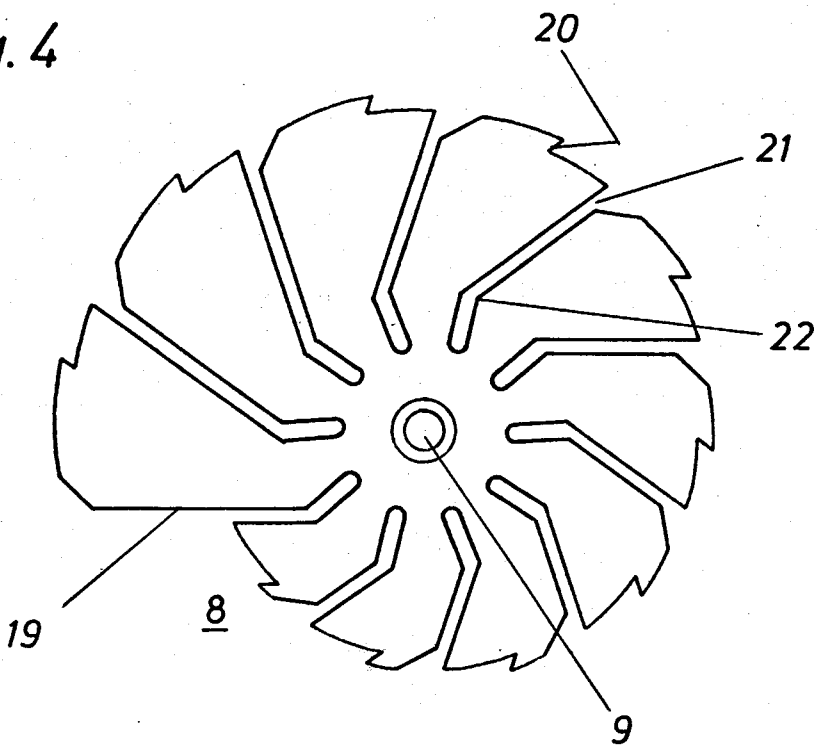
FIG. 4 is a side elevational view of an escapement wheel suitable for use with the toy gun shown in FIG. 1.

Referring now also to FIGS. 3, 4 and 5 of the accompanying drawings, the aforementioned plurality of corresponding portions situated around the periphery of the escapement wheel 8 preferably comprise a series of steps 20 cut out of the periphery of the wheel, as shown in FIG. 4. Each step 20 is engagable with the corresponding rearward portion of the trigger 5, as aforesaid. The escapement wheel 8 also includes a plurality of radially extending engagement means which preferably comprises a series of elongate slots 21 located at spaced apart intervals around the escapement wheel. Each slot 21 preferably includes an elbow section 22, as shown in FIG. 4.

In operation, the gun is loaded by passing each of a plurality of elasticized bands over the projection 10 at the forward end of the gun and engaging each band with a corresponding slot 21 in the escapement wheel 8. Because of its own elasticity, each band is thereby forced to enter the channel 11 through the narrow longitudinal opening communicating therewith so that it lies in a stretched condition along the projectile path through the body member. As each elasticized band is loaded into the gun is this way, the escapement wheel 8 is moved in the direction shown by the arrow in FIG. 1 through corresponding stages of rotation defined by each adjacent pair of steps 20 around the periphery of the wheel until each band is located in a corresponding slot 21. The elbow sections 22 in the slot 21 ensure a positive engagement of the elasticized bands within the slots.

During the loading operation, each elasticized band biases the escapement wheel for rotational movement in a direction opposite to that shown by the arrow in FIG. 1. As each band is loaded, however, rotation of the wheel in favour of this bias is prevented by engagement between the rearward portion of the trigger 5 and each corresponding step 20 around the periphery of the escapement wheel 8.

When the required number of elasticized bands has been loaded into the gun, each band may be fired from the gun by pressing the trigger 5 in a forward direction against the influence of elasticized band 6, thereby causing the escapement wheel 8 to rotate in a direction opposite to that shown by the arrow in FIG. 1 and causing each of the plurality of elasticized bands to become disengaged from its corresponding slot 21 as the latter falls into alignment with the projectile path. Each elasticized band is thus propelled along the projectile path and forwardly of the gun under the force of its own elasticity. Only a slight, instantaneous pressure on the trigger 5 causes the escapement wheel 8 to rotate between only one adjacent pair of steps 20 so that only one elasticized band is discharged from the gun. On the other hand, a "machine gun" effect can be achieved by applying a prolonged pressure to the trigger 5 so that the escapement wheel 8 is permitted to rotate through a plurality of steps 20 and a corresponding plurality of elasticized bands is discharged from the gun. The escapement wheel 8 continues to rotate under the influence of its rotational bias so that the gun consequently continues to discharge elasticized bands while ever a forward pressure is maintained on the trigger 5. The gun may be fully or partially reloaded after any number of elasticized bands have been discharged.

Referring particularly to FIGS. 4 and 5 of the accompanying drawings, the escapement wheel illustrated has ten radially extending slots 21 so that provision is made for the loading into the gun of up to ten elasticized bands at any one time. The number of slots 21 may, of course, be increased or decreased as required.

As will be noted from FIG. 4, the periphery of the escapement wheel 8 is defined by a radius increasing substantially linearly from a minimum to a maximum value for 360° of rotation. This helps to equalize the pressure between the rearward portion of the trigger 5 and each respective one of corresponding steps 20. Further, it is preferable to contour the upper and lower portions of the periphery of the escapement wheel surrounding each step 20 so as to match the contour of the corresponding rearward portion of the trigger 5. In use, when the gun is loaded to its full capacity, the first elasticized band to be loaded is engaged with slot 21 designated by the numeral 19 in FIG. 4.

Reference to the end elevational view of the escapement wheel 8 shown in FIG. 5 illustrates that the escapement wheel is preferably fabricated from two halves joined in the region of the hub 9 to form a gap 23. This feature establishes a straight line of sight through the gap 23 and along the projectile path to provide an accurate sighting system for the gun.

A further embodiment of the present invention provides that the gun is rendered incapable of firing any form of missle other than the elasticized bands with which the gun is intended to be used. Reference to FIG. 3 shows that channel 11 is internally divided so that the narrow elongate slot through which it communicates with the outside of the body member is extended vertically within the channel so that only a narrow, elongate section 18 actually constitutes the projectile path. This section is preferably large enough to only permit the passage of an elasticized band but to obstruct the passage of some other, more dangerous form of projectile, such as a pellet or the like.

A further preferred safety feature of the present invention is the provision of a narrow space 17 surrounding the projection 10 at the forward end of the body member. This prevents anyone from placing any other, more dangerous form of projectile under an elasticized band after the latter has been passed over the projection 10 and pulled to the inner end thereof by virtue of the tension placed on the band after it has been engaged with a correpsonding slot in the escapement wheel.

Referring generally to FIGS. 1, 2 and 3 of the accompanying drawings, the body member 2 is preferably fabricated in such a way that it includes fins 12 and 13 at each end of the narrow, elongate opening which communicates with the channel 11. These fins serve to direct each elasticized band toward the narrow, elongate opening and into the channel 11 and the bands are loaded into the gun.

FIG. 1 shows that the projection or spike 10 at the forward end of the body member is preferably tapered so that the plurality of elasticized bands, when loaded into the gun, lie adjacent one another along the projection 10. A further preferred limitation is that the projection 10 has a curved upper surface to prevent anyone from resting a dangerous projectile thereon for subsequent propulsion by an elasticized band leaving the gun.

Referring particularly to FIGS. 1 and 2 of the accompanying drawings, the toy gun of the present invention may also be provided with a forward hand grip 4 and a shoulder rest 15. The latter is attached to a rod 14 which is pivoted to the rearward hand grip 3 so that the shoulder rest may be swung forward when not in use (see FIG. 1) and may be swung rearward when required for use (see FIG. 2). A shoulder strap 16 may further be provided as an additional feature.

It is to be understood that the foregoing description is not specifically limiting to the scope of the present invention and that the toy gun herein described also makes known similar configurations of simpler construction. For example, the toy gun of the present invention anticipates a basic design in which the projectile path comprises a simple V section channel or, more simply, a flat, elongate surface along the top of the body member. Also, the hereinbefore described escapement wheel may be replaced by a simple spoked wheel having spokes which linearly increase from a minimum length to a maximum length over 360° of rotation of the wheel. In the latter case, the spokes serve to engage the elasticized bands to be fired as well as engaging with the rearward portion of the trigger to effect locking of the wheel against biased rotational movement when the gun is in a loaded condition.

What is claimed is:

1. A toy gun capable of propelling a plurality of elasticized band projectiles singly or in rapid succession comprising:

an elongate body member including forward and rearward ends and a projectile path therebetween;

a biased trigger mechanism mounted on said body member;

a rotatable escapement wheel rearwardly mounted on said body member having plural means normally engaged with said trigger mechanism to selectively prevent rotation of said wheel, said wheel further including radially extending means for individually engaging a plurality of projectiles; and a projection forward of said body adapted to releasably retain projectiles, said plural means being positioned to selectively permit rotation of said wheel to successively expel projectiles stretched between said projection and said wheel along said path, said wheel comprising a plurality of spaced apart radially extending sections having successively increasing radii around substantially the entire outermost periphery of the wheel (all the sections) and said wheel being biased by projectiles, when loaded, in a direction counter to the direction of increasing radius.

2. A toy gun as claimed in claim 1, wherein said plural means on said escapement wheel comprise a series of spaced apart steps cut into the periphery of the wheel and said plurality of radially extending means comprise a series of spaced apart, radially extending slots in the escapement wheel and communicating when the periphery thereof so that each said step is bounded by the points at which each coresponding pair of adjacent slots communicates with the periphery of the wheel.

3. A toy gun as claimed in claim 2, wherein said projectile path comprises a hollowed out, elongate channel longitudinal with said body member and communicating with the outside thereof through a narrow, elongate opening of substantially equal length as said channel, said channel being dimensioned so as to permit the passage therethrough of an elasticized band projectile but so as to obstruct the passage therethrough of any larger, more dangerous form of projectile.

4. A toy gun as claimed in claim 3, wherein said body member includes a pair of guide fins at each end of the narrow, elongate opening where the latter communicates with the outside of the body member.

5. A toy gun as claimed in claim 4, wherein said projection located forwardly of said projectile path comprises a forwardly projecting spike longitudinal with said body member and having top and bottom surfaces, said spike having a taper which increases from its forward to its rearward end, the top surface of said spike being curved about its axis.

6. A toy gun as claimed in claim 5, wherein said body member includes a first hand grip situated substantially in the vicinity of the rearward end of said body member, said trigger mechanism being housed within said hand grip and being spring loaded by means of an elasticized band passing around a forward portion of said trigger mechanism between points of anchorage on each side of said body member.

7. A toy gun as claimed in claim 6, wherein said body member includes a second hand grip located forwardly of said first hand grip.

8. A toy gun as claimed in claim 7, further comprising an elongate rod pivoted at one end to said first hand grip and releasably engagable with clip means integral with said second hand grip, the other end of said elongate rod being attached to a curved shoulder rest, said elongate rod being pivotable from a forwardly porjecting position wherein it is releasably engaged with said clip means to a rearwardly porjecting position wherein said shoulder rest is in the operative position.

* * * * *

UNITED STATES PATENT OFFICE

CERTIFICATE OF CORRECTION

Patent No. 4,223,658 Dated September 23, 1980

Inventor(s) PAUL SUNDSTROM

It is certified that error appears in the above-identified patent and that said Letters Patent are hereby corrected as shown below:

Column 5, lines 22-23, cancel "(all the sections)"; line 31, cancel "when" and insert --with--; line 33,"coresponding" should be --corresponding--.

Column 6, lines 34-35 and 36, "porjecting", each occurrence, should be --projecting--.

Signed and Sealed this

*Seventeenth* Day of *March 1981*

[SEAL]

*Attest:*

RENE D. TEGTMEYER

*Attesting Officer* *Acting Commissioner of Patents and Trademarks*